US009384745B2

(12) United States Patent
Siemes

(10) Patent No.: US 9,384,745 B2
(45) Date of Patent: Jul. 5, 2016

(54) ARTICLE OF MANUFACTURE, SYSTEM AND COMPUTER-READABLE STORAGE MEDIUM FOR PROCESSING AUDIO SIGNALS

(71) Applicant: NXP B.V., Eindhoven (NL)

(72) Inventor: Joerg Siemes, Dresden (DE)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 14/457,458

(22) Filed: Aug. 12, 2014

(65) Prior Publication Data

US 2016/0049155 A1 Feb. 18, 2016

(51) Int. Cl.

| | |
|---|---|
| ***G10L 19/008*** | (2013.01) |
| ***G10L 19/02*** | (2013.01) |
| ***G10L 21/0316*** | (2013.01) |
| ***H04H 20/22*** | (2008.01) |
| ***H04H 20/26*** | (2008.01) |

(52) U.S. Cl.

CPC ..... *G10L 19/02* (2013.01); *G10L 21/0316* (2013.01); *H04H 20/22* (2013.01); *H04H 20/26* (2013.01)

(58) Field of Classification Search

CPC ..... G10L 19/02
USPC ..... 704/500, 503
See application file for complete search history.

(56) References Cited

U.S. PATENT DOCUMENTS

2007/0293167 A1 12/2007 Shridhar et al.
2010/0232616 A1* 9/2010 Chamberlain ..... G10K 11/1784 381/71.1
2012/0170756 A1* 7/2012 Kraemer ..... H04S 7/302 381/17

FOREIGN PATENT DOCUMENTS

EP 2139133 A2 4/2009
EP 2139133 A3 4/2009

OTHER PUBLICATIONS

Extended European Search Report for Patent Appln. No. 15180687.4 (Feb. 25, 2016).

* cited by examiner

*Primary Examiner* — Marcellus Augustin

(57) ABSTRACT

Embodiments of an article of manufacture, a system for processing audio signals and a computer-readable storage medium containing program instructions for processing audio signals are described. In one embodiment, an article of manufacture comprising at least one non-transitory, tangible machine readable storage medium containing executable machine instructions for processing audio signals, where execution of the executable machine instructions by a processing device causes the processing device to perform steps, which include estimating a spectral difference between a first audio signal and a second audio signal that carry the same audio content, transforming the second audio signal based on the spectral difference and generating an output audio signal based on the transformed second audio signal. Other embodiments are also described.

16 Claims, 6 Drawing Sheets

ARTICLE OF MANUFACTURE, SYSTEM AND COMPUTER-READABLE STORAGE MEDIUM FOR PROCESSING AUDIO SIGNALS

Embodiments of the invention relate generally to signal processing systems and methods, and, more particularly, to articles of manufacture, systems and computer-readable storage medium for processing media signals.

An audio receiver system can receive identical audio content from different sources. For example, a radio receiver can receive the same broadcasting program in digital signal streams and in analog signal streams (e.g., in Amplitude modulation (AM) signals, frequency modulation (FM) signals, Digital Audio Broadcast (DAB) signals or Digital Radio Mondiale (DRM) signals). When audio signals from one audio source degrade in quality, a receiver can transition/switch to another audio source while keeping the audible effects of the signal transition minimal. However, audio signal streams of identical content that are received from different sources often have different properties in, for example, spectrum, stereo width and/or loudness. Consequently, transitioning or switching between different audio signal streams can cause undesirable audible effects. Particularly, when transitions between audio signals take place within a short time, such transitions can cause undesirable audible effects. In addition, slow transition or cross-fading between audio signals may lead to notch filter effects, when audio signals from two audio sources are not phase aligned over the complete spectrum, or when they have a time offset. Moreover, one audio source may degrade quickly such that there is insufficient audio information for cross-fading.

Embodiments of an article of manufacture, a system for processing audio signals and a computer-readable storage medium containing program instructions for processing audio signals are described. In one embodiment, an article of manufacture comprising at least one non-transitory, tangible machine readable storage medium containing executable machine instructions for processing audio signals, where execution of the executable machine instructions by a processing device causes the processing device to perform steps, which include estimating a spectral difference between a first audio signal and a second audio signal that carry the same audio content, transforming the second audio signal based on the spectral difference and generating an output audio signal based on the transformed second audio signal. The spectral difference between the first audio signal and the second audio signal may be caused by at least one of different transmitting settings, different reception conditions and different receiving distortions. Other embodiments are also described.

In one embodiment, a system for processing audio signals includes a signal estimator configured to estimate a spectral difference between a first audio signal and a second audio signal that carry the same audio content, a signal adaptor configured to transform the second audio signal based on the spectral difference and an audio output unit configured to generate an output audio signal based on the transformed second audio signal.

In one embodiment, a computer-readable storage medium contains program instructions for processing audio signals. Execution of the program instructions by one or more processors causes the one or more processors to perform steps including estimating a spectral difference between a first audio signal and a second audio signal that carry the same audio content, transforming the second audio signal based on the spectral difference and generating an output audio signal based on the transformed second audio signal.

Other aspects and advantages of embodiments of the present invention will become apparent from the following detailed description, taken in conjunction with the accompanying drawings, depicted by way of example of the principles of the invention.

Throughout the description, similar reference numbers may be used to identify similar elements.

It will be readily understood that the components of the embodiments as generally described herein and illustrated in the appended figures could be arranged and designed in a wide variety of different configurations. Thus, the following detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment. Rather, language referring to the features and advantages is understood to mean that a specific feature, advantage, or characteristic described in connection with an embodiment is included in at least one embodiment. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment. Thus, the phrases "in one embodiment," "in an embodiment," and similar language throughout this specification may, but do not necessarily, all refer to the same embodiment.

Figure 1:
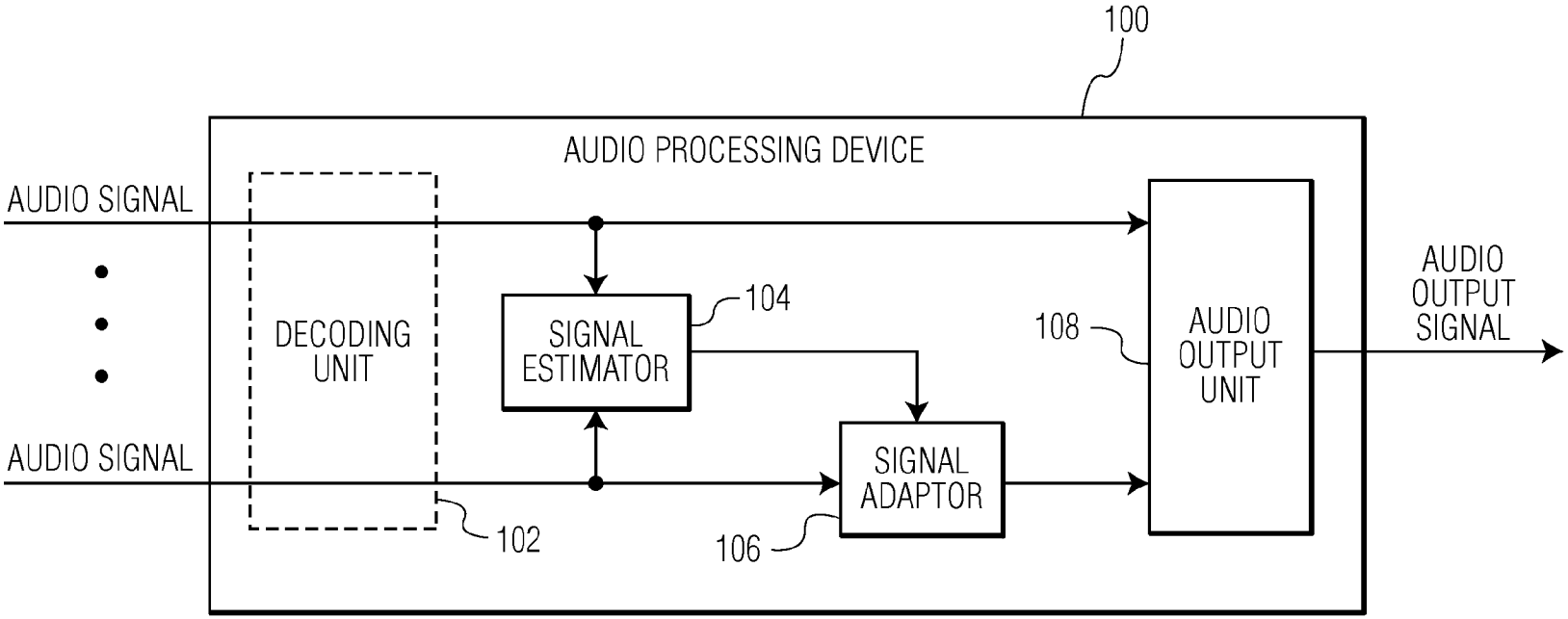
FIG. 1 is a schematic block diagram of an audio processing device in accordance with an embodiment of the invention.

FIG. 1 is a schematic block diagram of an audio processing device 100 in accordance with an embodiment of the invention. The audio processing device can be used to process different audio signals, which carry the same audio content (e.g., the same broadcasting program or the same song), to generate a processed audio signal. The audio processing device can handle any number of audio signals from two to tens of audio signals or more. In some embodiments, the audio processing device processes a digital audio signal and an analog audio signal, which may be an Amplitude modulation (AM) signal, a frequency modulation (FM) signal or a digitally encoded audio signal. In some embodiments, the audio processing device is used to process multi-channel audio signals, such as stereo audio signals.

The audio processing device 100 allows fast transitions between different audio signal streams while creating the impression of a slow "cross-fade" transition. An actual cross-fade between two audio signals may lead to frequency dependent audio attenuation, e.g. notch filter effects. The audio processing device avoids the need for an actual cross-fader and the unwanted notch filter effects. In addition, the audio processing device can be used in situations in which the quality of a primary audio signal stream degrades quickly such that a cross-fade based on the primary audio signal stream is not feasible. Furthermore, the audio processing device can be used when only one audio source decoder is available for multiple encoded streams, in order to create the impression of a cross fade even when the source decoder performs a hard switch from one audio source to another. In some embodiments, the audio processing device 100 is used to perform signal transition between different audio signals. In these embodiments, the audio processing device measures the properties of two audio signal streams and adapts a target audio signal stream such that the properties of the two audio signal streams are identical or close to each other. Consequently, the transition from one audio source to the other is made as inaudible as possible.

In the embodiment depicted in FIG. 1, the audio processing device 100 includes an optional decoding unit 102, a signal estimator 104, a signal adaptor 106 and an audio output unit 108. The audio processing device can be implemented in hardware, such as a processor or a receiver circuit and/or software (e.g., computer instructions) stored in a computer-readable storage medium (e.g., memory, cache, disk). Although the audio processing device is shown in FIG. 1 as including certain components, in some embodiments, the audio processing device includes less or more components to implement less or more functionalities. For example, the audio processing device may include an analog-to-digital converter (ADC) that is used to convert an analog audio signal into a digital audio signal and/or a delay device that is used to synchronize received audio signals. In some embodiments, the audio processing device includes a delay unit to delay a backup audio signal stream in order to avoid time differences between the backup audio signal stream and a primary audio signal stream.

The decoding unit 102 of the audio processing device 100 is configured to decode received audio signals. The decoding unit may include a single audio decoder for decoding multiple audio signal streams or a number of audio decoders in which each audio decoder decodes a separate audio signal stream. In one embodiment, the audio processing device includes only one audio source decoder that is configured to alternatively decoding multiple audio signal streams. Because the audio source decoder typically is the most resource intense component in the audio processing device, using only one audio source decoder for multiple audio signal streams leads to significant savings in execution cycles (e.g., million instructions per second (MIPS)) and/or memory or significant savings in circuitry substrate area for dedicated hardware based solutions.

The signal estimator 104 of the audio processing device 100 is configured to estimate the audio level over spectrum that can be generated from received audio signals that carry the same audio content. In one embodiment, the signal estimator controls the signal adaptor 106 to limit and distort a backup audio signal stream to desired properties so that the backup audio signal stream sounds the same or similar to a primary audio signal stream.

In some embodiments, the signal estimator 104 estimates one or more spectral differences between a primary audio signal and a backup audio signal, where the primary and backup audio signals carry the same audio content. The signal estimator may measure the signal magnitude/power level of the primary audio signal and the backup audio signal in one or more frequency ranges. The signal estimator may transform both primary and backup audio signals into the spectral/frequency domain, e.g. via discrete Fourier transform (DFT) such as fast Fourier transform (FFT), and then estimate the signal magnitude/power level within certain frequency segments. In one embodiment, the signal estimator calculates a power ratio between the magnitude of the primary audio signal and the magnitude of the backup audio signal.

Figure 2:
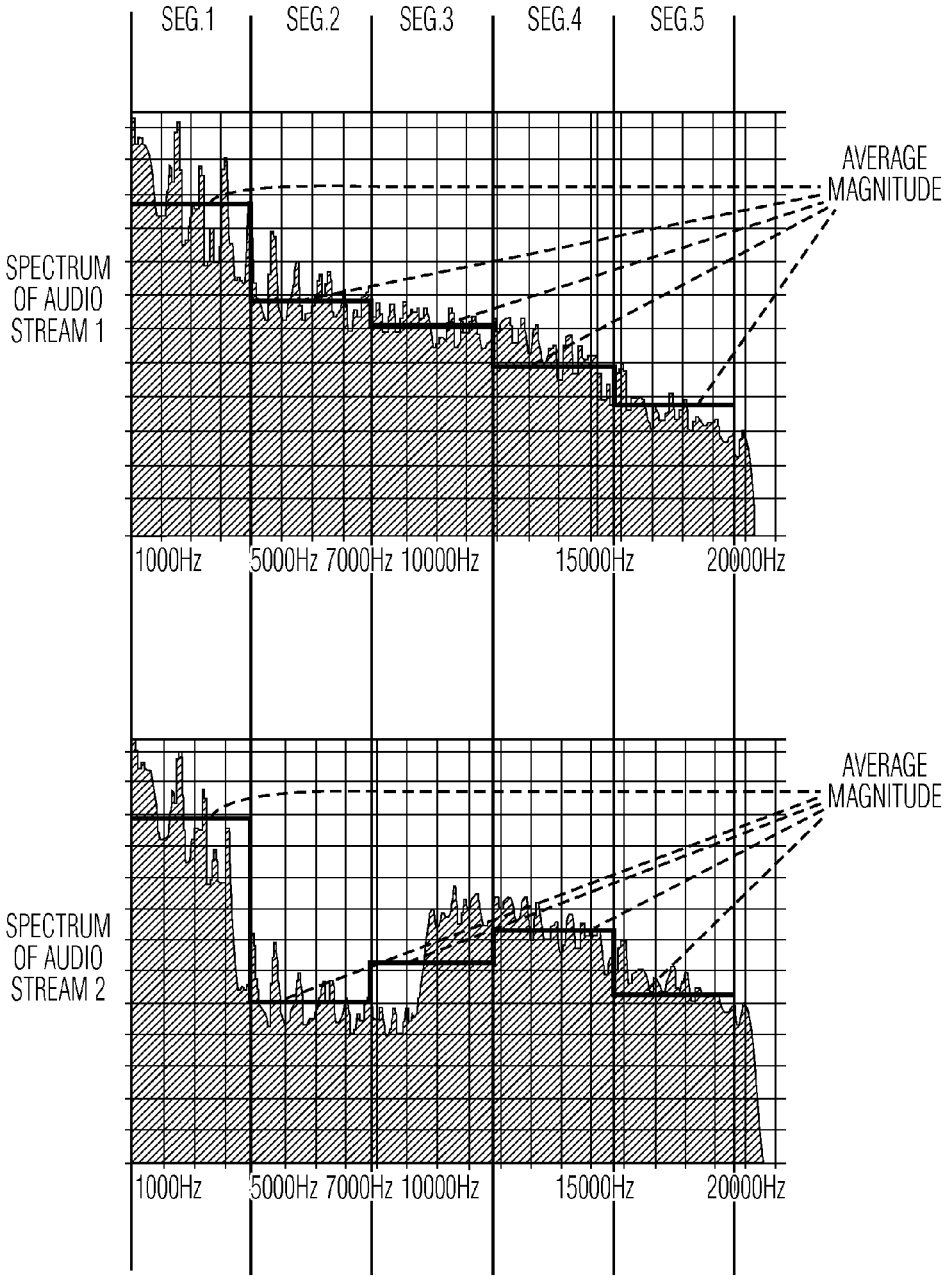
FIG. 2 depicts some examples of frequency spectrum of two audio signal streams that can be used by a signal estimator of the audio processing device depicted in FIG. 1 for estimating signal differences.

FIG. 2 depicts some examples of frequency spectrum of two audio signal streams that can be used by the signal estimator 104 for estimating signal differences. As shown in FIG. 2, the frequency spectrum of a first audio signal stream and the frequency spectrum of a second audio signal stream are divided into 5 segments, where each segment extends a frequency range of around 4000 Hertz (Hz). Depending on measurement time, processing power and targeted audio performance, these frequency segments may be set smaller or larger than 4000 Hz. In each frequency segment of an audio signal stream, the signal estimator calculates an average magnitude/power for the audio signal stream, regardless of the phase of the audio signal stream. In some embodiments, the signal estimator calculates a relative signal power ratio in each of these 5 segments as the ratio between the average magnitude/power of the first audio signal stream in that segment and the average magnitude/power of the second audio signal stream in that segment.

Turning back to FIG. 1, the signal adaptor 106 of the audio processing device 100 is configured to control the passage of an audio signal. In some embodiments, the signal adaptor transforms a backup audio signal based on the spectral difference in response to a degrade in quality of a primary audio signal. The signal adaptor may change one or more properties of an audio signal received from one audio signal source to be identical with or similar to the corresponding properties of another audio signal received from a different audio signal source. In some embodiments, the signal estimator 104 monitors the quality of received audio signals to determine a degrade in quality of an audio signal. Typical digital or analog radio receivers can make signal quality parameters, e.g., the signal strength, the signal to noise ratio or the bit error rate of a received stream, available to subsequent blocks. The signal estimator can use the signal quality parameters of an audio signal to determine a degrade in quality of the audio signal. A receiver may also indicate that the received audio signal stream has already been manipulated, e.g., in spectrum or stereo width, such that the audio processing device can use this information for audio adaptations. In one embodiment, the signal adaptor changes one or more spectral properties of an audio signal received from one audio signal source to a level that is deemed sufficient for a pleasant audio transition from another audio signal received from a different audio signal source. In some embodiments, the signal adaptor allows the passage of an audio signal without any alternation. In some embodiments, the signal adaptor may be switched off to get the non-distorted audio of a backup audio signal stream if a primary audio signal stream degrades in quality. In these embodiments, the switching-off of the signal adaptor may be done in gradual steps as to simulate a smooth audio signal cross-fading.

Figure 3:
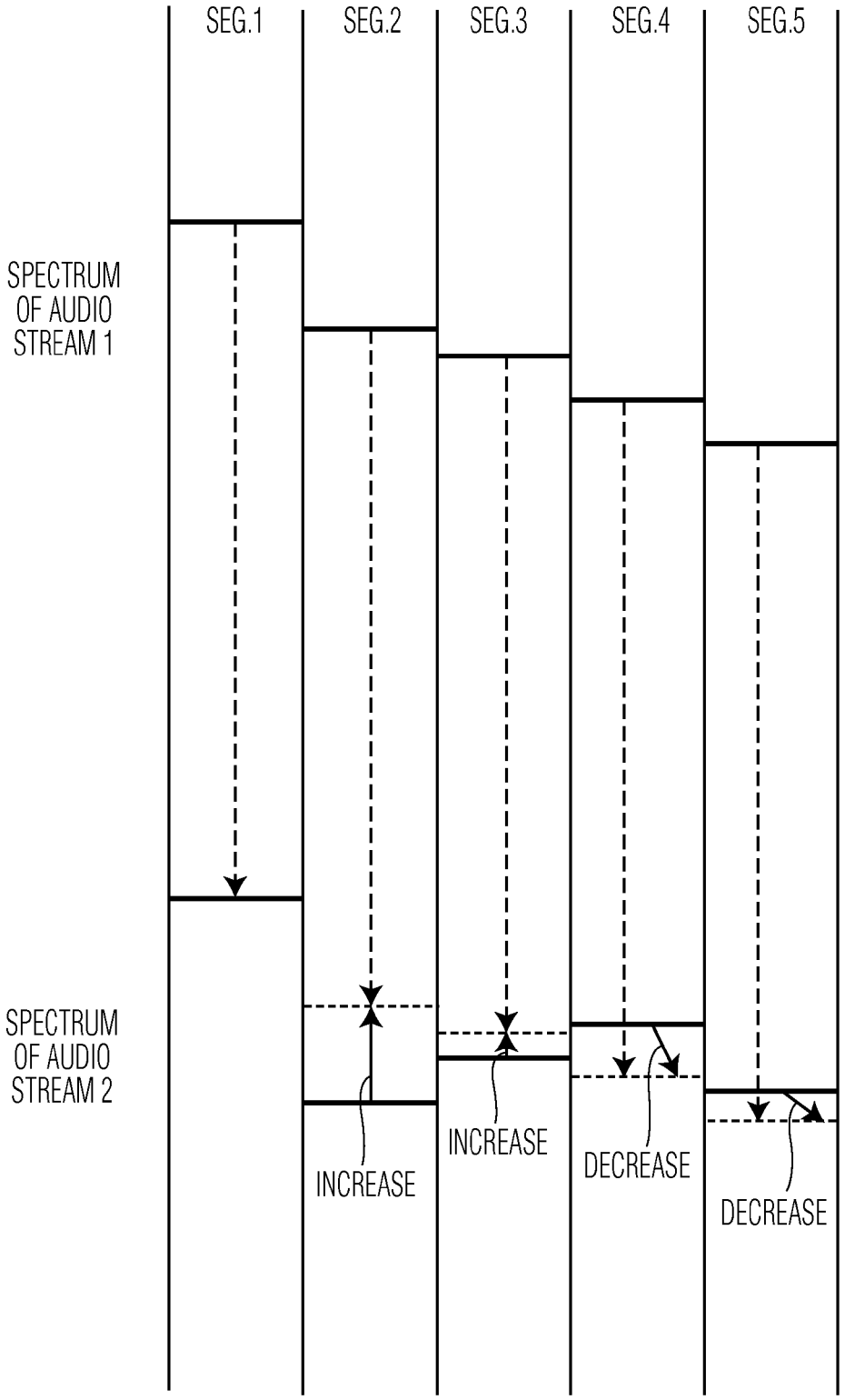
FIG. 3 illustrates an example of the operation of a signal adaptor of the audio processing device depicted in FIG. 1.

FIG. 3 illustrates an example of the operation of the signal adaptor 106. Specifically, FIG. 3 shows the frequency spectrum of a first audio signal stream and the frequency spectrum of a second audio signal stream before signal adaptation and after signal adaptation. As shown in FIG. 3, the frequency spectrums of the first and second audio signal streams are divided into 5 segments, where each segment extends a frequency range of around 4000 Hz. As depicted in FIG. 3, the first audio signal stream degrades in quality and the signal adaptor transforms the second audio signal stream to be the same as the first audio signal stream. In each frequency segment, the signal adaptor compares the average magnitude/power of the second audio signal stream with the average magnitude/power of the first audio signal stream and adapts the average magnitude/power of the second audio signal stream to be the same as the average magnitude/power of the first audio signal stream. For example, in the first frequency segment (Seg. 1), the signal adaptor determines that the average magnitude/power of the second audio signal stream is the same as the average magnitude/power of the first audio signal stream and leaves the second audio signal stream unchanged in the first frequency segment. In the second and third frequency segments (Seg. 2 and Seg. 3), the signal adaptor determines that the average magnitude/power of the second audio signal stream is less than the average magnitude/power of the first audio signal stream and increases the magnitude/power of the second audio signal stream. In the fourth and fifth frequency segments (Seg. 4 and Seg. 5), the signal adaptor determines that the average magnitude/power of the second audio signal stream is greater than the average magnitude/power of the first audio signal stream and decreases the magnitude/power of the second audio signal stream. In some embodiments, the signal adaptor transfers the second audio signal stream to the frequency/spectral domain, changes the signal power in the corresponding frequency segments, and transforms the adapted second audio signal stream back into the time domain and combines these frequency segments. In some embodiments, the signal adaptor routes the second audio signal stream through an appropriate filter bank, e.g. a number of parallel band-pass filters, where each filter has an amplification/attenuation factor that is determined based on the relative signal power ratio between the first audio signal stream and the second audio signal stream calculated by the signal estimator 104.

Turning back to FIG. 1, the audio output unit 108 of the audio processing device 100 is configured to generate an audio output signal based on the audio signals received at the audio processing device. In some embodiments, the audio output unit generates the output audio signal based on a transformed backup audio signal in response to a degrade in quality of a primary audio signal. The audio output unit may include an audio selector or a signal cross-fader. In some embodiments, the audio output unit includes an audio selector, which is configured to select a received audio signal or an adapted audio signal as the output signal of the audio processing device. The audio selector can monitor the quality of audio signals that are inputted into the audio selector. In some embodiments, the audio selector selects a backup audio signal stream received from the signal adaptor 106 once a primary audio signal stream degrades in quality. Alternatively, the audio output unit includes a signal cross-fader configured to cross-fade a transformed backup audio signal from the signal adaptor 106 with a primary audio signal.

Figure 4:
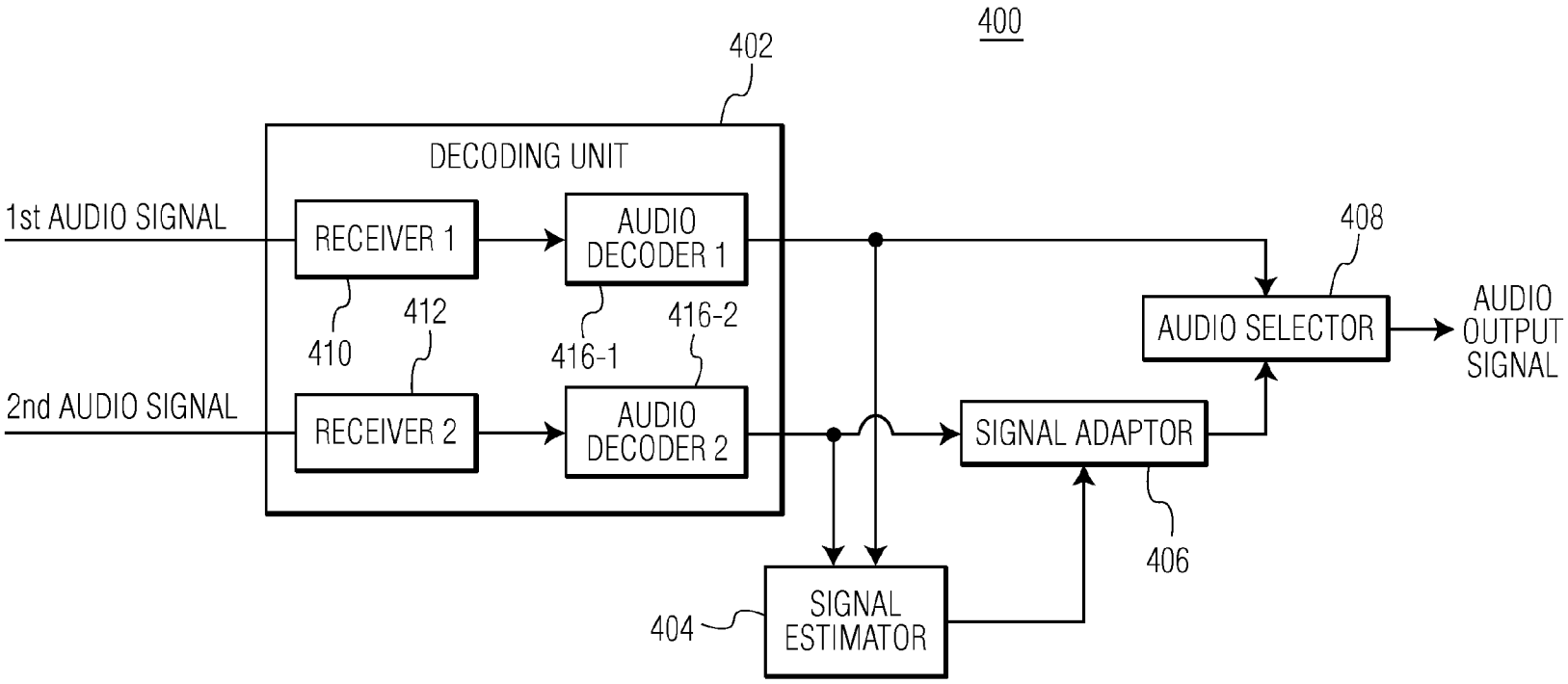
FIG. 4 depicts an embodiment of the audio processing device depicted in FIG. 1.

FIG. 4 depicts an embodiment of the audio processing device 100 depicted in FIG. 1. In the embodiment depicted in FIG. 4, an audio processing device 400 includes a decoding unit 402, a signal estimator 404, a signal adaptor 406 and an audio selector 408. The audio processing device depicted in FIG. 4 can be used in a hybrid radio device that simultaneously receives an analog broadcast and a digital radio broadcast of the same program, or in a device that receives two digital radio broadcasts with the same audio content, but through two different radio stations with possibly different digital transmission stream properties. The audio processing device depicted in FIG. 4 is one possible embodiment of the audio processing device depicted in FIG. 1. However, the audio processing device depicted in FIG. 1 is not limited to the embodiment shown in FIG. 4. As an example, in some embodiments, the audio processing device may include an analog-to-digital converter (ADC) that is used to convert an analog audio signal into a digital audio signal.

The decoding unit 402 of the audio processing device 400 includes a first receiver module (receiver 1) 410, a second receiver module (receiver 2) 412, a first audio decoder (audio decoder 1) 416-1 and a second audio decoder (audio decoder 2) 416-2. The first receiver module is configured to receive a first audio signal. The first audio decoder is configured to decode the first audio signal received at the first receiver module. The second receiver module is configured to receive a second audio signal, which carries the same audio content as the first audio signal. The second audio decoder is configured to decode the second audio signal received at the second receiver module. In some embodiments, each of the first and second receiver modules is implemented by a signal reception circuit, such as an Input/Output terminal/interface.

The signal estimator 404 is configured to estimate a spectral difference between the first audio signal and the second audio signal. The signal adaptor 406 is configured to transform the second audio signal based on the estimated spectral difference in response to a degrade in quality of the first audio signal. The audio selector 408 is configured to select the first audio signal as the output audio signal of the audio processing device 400 in case that the quality of the first audio signal is in an acceptable range and select the transformed second audio signal as the output audio signal of the audio processing device in case there is a degrade in quality of the first audio signal.

In an example of the operation of the audio processing device 400, the signal estimator 404 measures the magnitudes of the received first and second audio signals in the same frequency range and calculates a power ratio between the magnitude of the first audio signal and the magnitude of the second audio signal. When the quality of the first audio signal is in an acceptable range, the signal adaptor 406 is not active (i.e., performs no transformation to the second audio signal) and the audio selector 408 selects the first audio signal as the output audio signal of the audio processing device 400. Upon a determination that there is a degrade in quality of the first audio signal, the signal adaptor changes the magnitude of the second audio signal to be identical with the magnitude of the first audio signal based on the calculated power ratio and the audio selector selects the transformed second audio signal as the output audio signal of the audio processing device.

Figure 5:
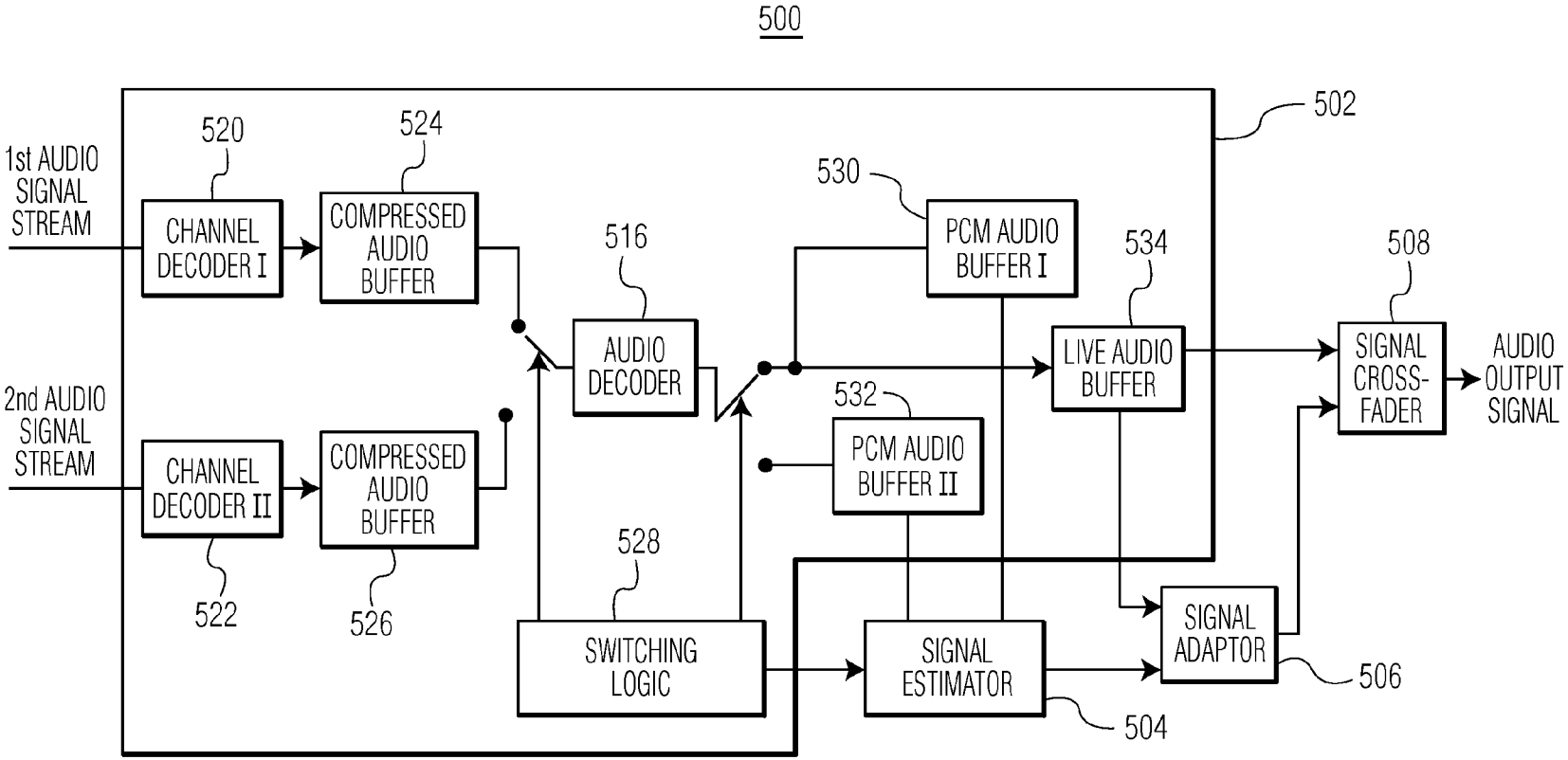
FIG. 5 depicts another embodiment of the audio processing device depicted in FIG. 1.

Turning back to FIG. 1, in some embodiments, the audio processing device 100 includes only a single audio source decoder for decoding multiple audio signal streams, e.g., in case of embedded systems with limited processing resources or because of memory restrictions. FIG. 5 depicts an embodiment of the audio processing device 100 depicted in FIG. 1 that has a single audio source decoder 516 for decoding two audio signal streams. In the embodiment depicted in FIG. 5, an audio processing device 500 includes a decoding unit 502, which includes the single audio source decoder 516 for decoding two audio signal streams, a signal estimator 504, a signal adaptor 506 and a signal cross-fader 508. The audio processing device depicted in FIG. 5 can be used in a hybrid radio device that simultaneously receives an analog broadcast and a digital radio broadcast of the same program, or in a device that receives two digital radio broadcasts with the same audio content, but through two different radio stations with possibly different digital transmission stream properties. The audio processing device depicted in FIG. 5 is one possible embodiment of the audio processing device depicted in FIG. 1. However, the audio processing device depicted in FIG. 1 is not limited to the embodiment shown in FIG. 5.

The decoding unit 502 is configured to decode first and second audio signal streams that are received at the audio processing device 500. The signal estimator 504 is configured to estimate spectral differences between the first and second audio signal streams. The signal adaptor 506 is configured to transform the second audio signal stream based on the estimated spectral differences of the first and the second audio signal streams. The signal cross-fader 508 is configured to select the first audio signal stream as the output of the audio processing device 500 in case that the quality of the first audio signal stream is in an acceptable range. In case there is a degrade in quality of the first audio signal stream, the signal cross-fader cross-fades or switches the transformed or adapted second audio signal stream from the first audio signal stream to generate an inaudible transition from the first to the second audio signal stream as the output of the audio processing device. The audio processing device 500 may gradually reduce the spectral adaptations of the second audio signal stream, and thereby create the impression of an audio signal cross-fade. In another embodiment, the decision for switching or fading to the second audio signal stream may be given by an external input, e.g., from a device that has knowledge or estimations about impending changes in quality of the first audio signal stream (e.g. by monitoring error information or by geographical knowledge of transmitter positions and receiver position etc.)

The decoding unit 502 of the audio processing device 500 includes a first channel decoder (channel decoder I) 520, a second channel decoder (channel decoder II) 522, a first compressed audio buffer 524, a second compressed audio buffer 526, a switching logic 528, the audio decoder 516, a first Pulse-code modulation (PCM) audio buffer (PCM audio buffer I) 530, a second PCM audio buffer (PCM audio buffer II) 532 and a live audio buffer 534. The first and second channel decoder is configured to perform channel decoding to a first audio signal stream (or a primary audio signal stream) and a second audio signal stream (or a backup audio signal stream), respectively. The compressed audio buffers, the PCM audio buffers and the live audio buffer are configured to buffer or store corresponding audio signals. The switching logic is configured to connect the audio decoder 516 to the first compressed audio buffer, the second compressed audio buffer, the first PCM audio buffer, and/or the second PCM audio buffer such that the audio decoder 516 can decode either the first audio signal stream or the second audio signal stream.

In order to analyze the spectral differences between two audio signal streams, a section of identical decoded content must be available from both audio signal streams. In some embodiments, the decoding unit 502 buffers a certain amount of decoded audio content of the first audio signal stream in the live audio buffer 534. These stored PCM samples make it possible to temporarily use the audio decoder 516 for decoding the second compressed audio signal stream, while replay of the first audio signal stream continues from the live audio buffer 534. The decoding unit also buffers a copy of the decoded audio in the first PCM audio buffer 530, until sufficient decoded audio for a spectral alignment operation is stored in the first PCM audio buffer. In parallel with the processing of the first audio signal stream, the decoding unit buffers the matching audio content from the second audio signal stream in the second compressed audio buffer 526 without decoding the matching audio content. Once the live audio buffer of the first audio signal stream is sufficiently filled, the audio decoder starts to decode the encoded second audio signal stream stored in the second compressed audio buffer, while playing samples from the first audio signal stream from the live audio buffer. Before the live audio buffer runs empty, the audio decoder 516 switches back to the primary audio signal stream to provide live PCM samples for the audio output, and to slowly increase the live PCM buffer content again. Once the live audio buffer is sufficiently filled again, the process is repeated, until all compressed audio from the compressed audio buffer 526 is decoded into the second PCM audio buffer 532. After an identical section of the first and second audio signal streams is present in the first and second PCM audio buffers, respectively, the signal estimator 504 analyzes the spectral differences between the first and second audio signal streams.

In an example of the operation of the audio processing device 500, the decoding unit 502 switches the audio decoder 516 from decoding the first audio signal stream to decoding the second audio signal stream. While samples of the first audio signal stream are played from the live audio buffer 534, the decoding unit decodes the second audio signal stream. The decoded second audio signal stream is routed through the signal adaptor 506 and used for a cross-fade with the decoded first audio signal stream in the signal cross-fader 508. The signal adaptor transforms the second audio signal stream to ensure that even a relatively short cross-fade does not cause noticeably changes in the cross-faded audio signal stream. The signal adaptor may be switched off in gradual steps such that the frequency dependent level adaptation in the audio output signal reduces progressively. After the signal adaptor is switched off completely, the audio processing device outputs the original second audio signal stream as the output of the audio processing device.

Figure 6:
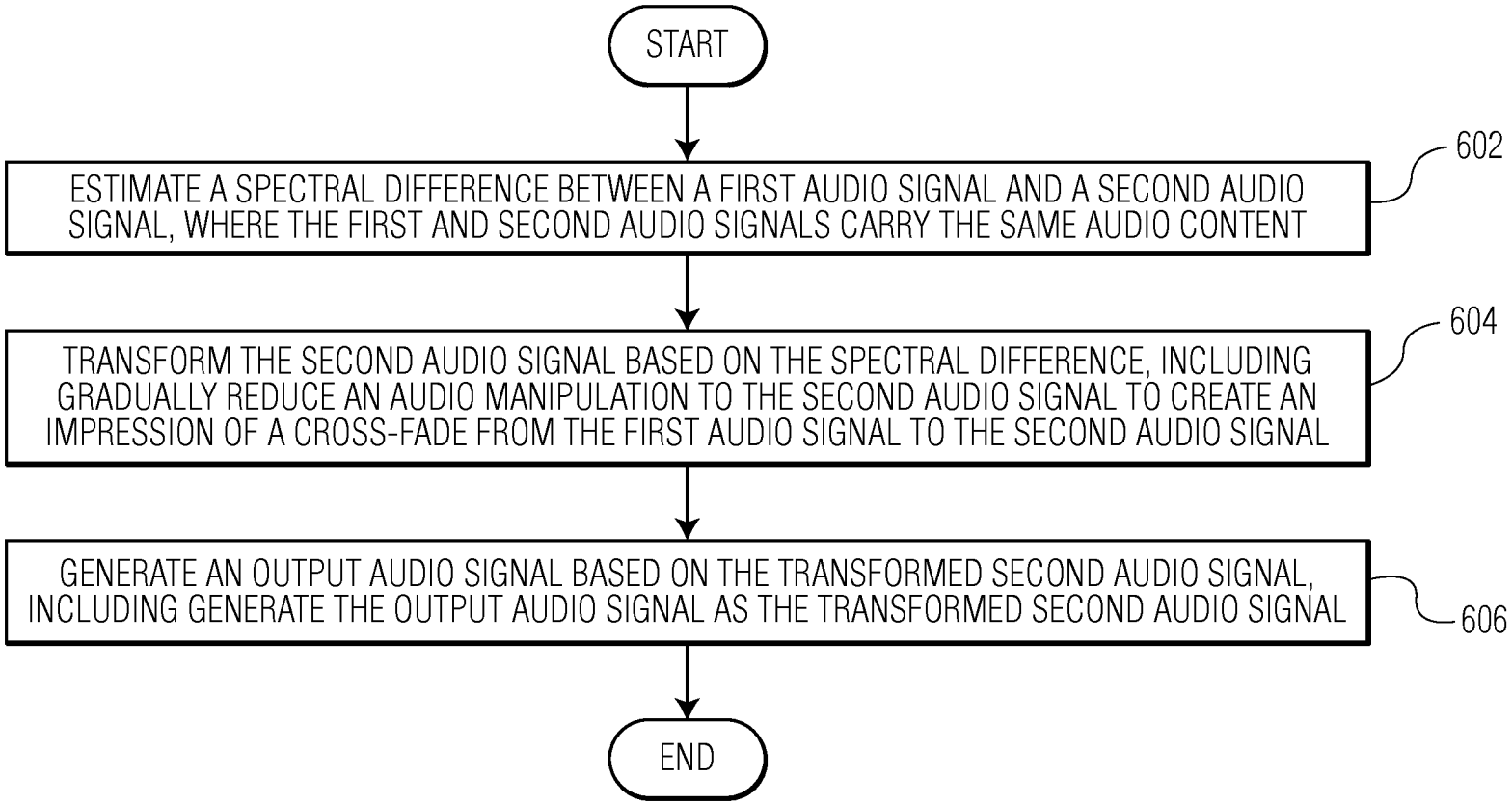
FIG. 6 is a process flow diagram of a method for processing audio signals in accordance with an embodiment of the invention.

FIG. 6 is a process flow diagram of a method for processing audio signals in accordance with an embodiment of the invention. At block 602, a spectral difference between a first audio signal and a second audio signal is estimated, where the first and second audio signals carry the same audio content. At block 604, the second audio signal is transformed based on the spectral difference. An audio manipulation to the second audio signal is gradually reduced to create an impression of a cross-fade from the first audio signal to the second audio signal. The spectral difference between the first audio signal and the second audio signal may be caused by different transmitter settings, different reception conditions, or different receiver distortions, for example, based on low reception quality and possibly subsequent "weak signal handling" audio manipulation. At block 606, an output audio signal is generated based on the transformed second audio signal. The output audio signal is generated as the transformed second audio signal.

Although the operations of the method herein are shown and described in a particular order, the order of the operations of the method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

It should also be noted that at least some of the operations for the methods may be implemented using software instructions stored on a computer useable storage medium for execution by a computer. As an example, an embodiment of an article of manufacture or a computer program product includes a computer useable storage medium to store a computer readable program that, when executed on one or more processors, causes the one or more processors to perform operations, as described herein.

In addition, embodiments of at least portions of the invention can take the form of a computer program product accessible from a computer-usable or computer-readable medium providing program code for use by or in connection with a processor, a computer or any instruction execution system. For the purposes of this description, a computer-usable or computer readable medium can be any apparatus that can contain, store, communicate, propagate, or transport the program for use by or in connection with the instruction execution system, apparatus, or device. The computer-useable or computer-readable medium can be an electronic, magnetic, optical, electromagnetic, infrared, or semiconductor system (or apparatus or device), or a propagation medium. Examples of a computer-readable medium include a semiconductor or solid state memory, magnetic tape, a removable computer diskette, a random access memory (RAM), a read-only memory (ROM), a rigid magnetic disc, and an optical disc. Current examples of optical discs include a compact disc with read only memory (CD-ROM), a compact disc with read/write (CD-R/W), a digital video disc (DVD), and a Blu-ray disc.

In the above description, although specific embodiments of the invention that have been described or depicted include several components described or depicted herein, other embodiments of the invention may include fewer or more components to implement less or more features.

Furthermore, although specific embodiments of the invention have been described and depicted, the invention is not to be limited to the specific forms or arrangements of parts so described and depicted. The scope of the invention is to be defined by the claims appended hereto and their equivalents.

What is claimed is:

1. An article of manufacture comprising at least one non-transitory, tangible machine readable storage medium containing executable machine instructions for processing audio signals, wherein execution of the executable machine instructions by a processing device causes the processing device to perform steps, which comprise:

estimating a spectral difference between a first audio signal and a second audio signal, wherein the first and second audio signals carry the same audio content;

transforming the second audio signal based on the spectral difference in response to a degrade in quality of the first audio signal; and generating an output audio signal based on the transformed second audio signal, wherein estimating the spectral difference between the first audio signal and the second audio signal comprises;

measuring the magnitude of the first audio signal in a frequency range and the magnitude of the second audio signal in the frequency range; and calculating a power ratio between the magnitude of the first audio signal and the magnitude of the second audio signal.

2. The article of manufacture of claim 1, wherein the spectral difference between the first audio signal and the second audio signal is caused by at least one of different transmitting settings, different reception conditions and different receiving distortions.

3. The article of manufacture of claim 1, wherein transforming the second audio signal based on the spectral difference comprises:

comparing the magnitude of the second audio signal with the magnitude of the first audio signal; and if the magnitude of the second audio signal is different from the magnitude of the first audio signal, changing the magnitude of the second audio signal to be identical with the magnitude of the first audio signal.

4. The article of manufacture of claim 1, wherein transforming the second audio signal based on the spectral difference comprises:

changing the magnitude of the second audio signal based on the power ratio.

5. The article of manufacture of claim 1, wherein generating the output audio signal based on the transformed second audio signal comprises:

generating the output audio signal as the transformed second audio signal.

6. The article of manufacture of claim 1, wherein generating the output audio signal based on the transformed second audio signal comprises:

cross-fading or switching the transformed second audio signal with the first audio signal.

7. The article of manufacture of claim 1, wherein transforming the second audio signal based on the spectral difference comprises:

transforming the second audio signal based on the spectral difference such that the transformed second audio signal is identical with the first audio signal.

8. The article of manufacture of claim 1, the steps further comprising:

alternatively decoding the first and second audio signals using a single audio source decoder.

9. The article of manufacture of claim 1, wherein transforming the second audio signal based on the spectral difference comprises:

gradually reducing an audio manipulation to the second audio signal to create an impression of a cross-fade from the first audio signal to the second audio signal, and wherein generating the output audio signal based on the transformed second audio signal comprises:

generating the output audio signal as the transformed second audio signal.

10. A system for processing audio signals, the system comprising:

a signal estimator configured to estimate a spectral difference between a first audio signal and a second audio signal, wherein the first and second audio signals carry the same audio content;

a signal adaptor configured to transform the second audio signal based on the spectral difference in response to a degrade in quality of the first audio signal; and an audio output unit configured to generate an output audio signal based on the transformed second audio signal, wherein the signal estimator is further configured to:

measure the magnitude of the first audio signal in a frequency range and the magnitude of the second audio signal in the frequency range; and calculate a power ratio between the magnitude of the first audio signal and the magnitude of the second audio signal.

11. The system of claim 10, wherein the spectral difference between the first audio signal and the second audio signal is caused by at least one of different transmitting settings, different reception conditions and different receiving distortions.

12. The system of claim 10, wherein the signal estimator is further configured to:

compare the magnitude of the second audio signal with the magnitude of the first audio signal; and if the magnitude of the second audio signal is different from the magnitude of the first audio signal, change the magnitude of the second audio signal to be identical with the magnitude of the first audio signal.

13. The system of claim 10, wherein the audio output unit is further configured to:

cross-fade or switch the transformed second audio signal with the first audio signal.

14. The system of claim 10, further comprising:

a single audio source decoder configured to alternatively decode the first and second audio signals.

15. The system of claim 10, wherein the signal adaptor is further configured to gradually reduce an audio manipulation to the second audio signal to create an impression of a cross-fade from the first audio signal to the second audio signal, and wherein the audio output unit is configured to generate the output audio signal as the transformed second audio signal.

16. A non-transitory computer-readable storage medium containing program instructions for processing audio signals, wherein execution of the program instructions by one or more processors causes the one or more processors to perform steps comprising:

estimating a spectral difference between a first audio signal and a second audio signal, wherein the first and second audio signals carry the same audio content;

transforming the second audio signal based on the spectral difference in response to a degrade in quality of the first audio signal; and generating an output audio signal based on the transformed second audio signal, wherein estimating the spectral difference between the first audio signal and the second audio signal comprises:

measuring the magnitude of the first audio signal in a frequency range and the magnitude of the second audio signal in the frequency range; and calculating a power ratio between the magnitude of the first audio signal and the magnitude of the second audio signal.

* * * * *